US006799887B1

(12) United States Patent
Kinney

(10) Patent No.: US 6,799,887 B1
(45) Date of Patent: Oct. 5, 2004

(54) WRISTWATCH GUARD WITH ACCESS FLAP

(76) Inventor: Joseph Chadwick Kinney, 3385 Sunchase Ct., Mobile, AL (US) 36695

( * ) Notice: Subject to any disclaimer, the term of this patent is extended or adjusted under 35 U.S.C. 154(b) by 0 days.

(21) Appl. No.: 09/550,983

(22) Filed: Apr. 17, 2000

(51) Int. Cl.[7] ..... G04B 37/14
(52) U.S. Cl. ..... 368/282; 368/281
(58) Field of Search ..... 368/286, 281, 368/282, 283; 224/168, 164, 176, 901.4, 170, 165, 171, 219, 1, 173; D10/31, 32

(56) References Cited

U.S. PATENT DOCUMENTS 2,998,695 A * 9/1961 Cornett ..... 368/286
3,712,049 A * 1/1973 Luxembourgh ..... 368/286
4,103,808 A * 8/1978 Hallman et al. ..... 368/286
4,155,219 A * 5/1979 Anderson ..... 368/382
4,916,679 A * 4/1990 Agnello ..... 368/283
5,035,000 A * 7/1991 Matthias ..... 224/171
5,272,682 A * 12/1993 Falcone ..... 368/286
5,332,135 A * 7/1994 Fletcher ..... 368/283
5,636,775 A * 6/1997 Kartsotis et al. ..... 224/165
5,762,241 A * 6/1998 Cross ..... 224/173
5,769,290 A * 6/1998 Pestana ..... 224/178
5,812,500 A * 9/1998 Webb, Jr. ..... 368/282
5,838,642 A * 11/1998 Tully ..... 368/282
6,199,730 B1 * 3/2001 Chisolm ..... 224/164
6,223,958 B1 * 5/2001 Kohn ..... 224/219
6,234,668 B1 * 5/2001 Cooper ..... 368/281
D458,852 S * 6/2002 Blauner et al. ..... D10/32
D471,114 S * 3/2003 Chong ..... D10/31

* cited by examiner

*Primary Examiner*—David Martin
*Assistant Examiner*—Jeanne-Marguerite Goodwin
(74) *Attorney, Agent, or Firm*—John Wiley Horton

(57) ABSTRACT

A device for protecting a wristwatch being worn on a user's wrist. The device slips around and secures itself over the watch body and watch band. A cover flap is provided to removably cover the watch face. A secured storage pocket is also provided, allowing the user to store small items.

4 Claims, 5 Drawing Sheets

WRISTWATCH GUARD WITH ACCESS FLAP

BACKGROUND

1. Field of Invention

This invention relates to the field of wristwatches. More specifically, the invention comprises an adjustable and flexible protective band which fits over a wristwatch. The invention locks itself to the wristwatch without the need for any separate attachment features.

2. Description of Prior Art

Wristwatches are one of the great conveniences of the modern age. Unfortunately, due to their exposed position, they are subject to damage. Virtually any type of physical labor puts a wristwatch in danger of being damaged. This is particularly true of construction labor and strenuous outdoor sports—such as water skiing or scuba diving.

For those persons with expensive watches, the only option is often to remove the watch until the physical activity is done, leaving them without the ability to tell time. Alternatively, many wristwatch wearers elect to purchase a second inexpensive "sport" watch. Under either option, the wearer must remove the more expensive watch and leave it—subjecting it to potential loss or theft. Thus, there has been a long felt need for some type of protective device that would allow a wristwatch wearer to wear the watch during physical activity.

Such protective devices are known in the prior art. One such device is disclosed in U.S. Pat. No. 4,155,219 to Anderson (1979). The Anderson device uses a wide leather strap to cover a watch and a band. In its preferred embodiment, the device is intended to replace the conventional watch band. The wearer uses VELCRO attachment features to secure a watch body directly to the device (FIG. 2 of the Anderson disclosure). Alternatively, the user can place the strap around both a watch and its watchband, though it is difficult to see how the device will remain in position if used in this way.

The Anderson device discloses a top flap which is used to cover the face of the watch. The user can look at the watch by peeling back this flap. The flap has securing means so that it can be retained in the open position in order to allow the user to inspect the watch at any time. Unfortunately, the '219 device does not work well without removing the watch band. This fact means that the user must convert his watch to a full-time guarded configuration. From a practical standpoint, only the nicer watches are worth guarding. The '219 is thus disfiguring a nice watch. It is unlikely that the user would want to wear such a bulky and unattractive device on all occasions. Thus, a guard which does not alter the watch would certainly be preferable.

Another type of watch protector is disclosed in U.S. Pat. No. 4,277,842 to Richards (1981). The Richards invention uses a flexible cloth cover with a protective crystal positioned over the face of the watch. The device is held in place by the fact that it has a rigid frame member fitting over the body of a square watch. The method appears effective, but it is significant to note that it is dependent upon the square watch body style, which was prevalent with digital watches. Given the time when the Richards device was created, this feature was not a big disadvantage. Unfortunately, modern watches are seldom square-bodied. Thus, the Richards device suffers from the same inability to remain in position over a watch and band that appears to trouble the Anderson device.

Another approach is taken in U.S. Pat. No. 4,509,644 to Kulick (1985). This invention uses an adhesively bonded clear cover to protect the watch body. As is readily seen in FIGS. 4 through 6 of the disclosure, the cover must be carefully tailored to conform to a particular watch body. Thus, a single protector could not serve to protect a variety of watches. This fact is an obvious disadvantage. In addition, the fact that the cover is adhesively bonded to the watch means it cannot be applied and removed repeatedly without disfiguring the watch.

A rigid watch guard is disclosed in U.S. Pat. No. 4,835,750 to Quincey (1989). The Quincey device has a circular guard intended to fit over the watch body. It also has two brackets extending from either side of the circular guard which are intended to secure the device to the watch band. Thus, it is possible to use the Quincey device while the watch band is still in place. As may be readily observed, however, the invention can only be used on certain watch styles. It is further restricted by the type of band which the attachment brackets may engage.

U.S. Pat. No. 4,916,679 to Agnello (1990) discloses an elastic watch cover with encapsulating side walls. This device is designed to fit around the sides of a watch band, as well as over its top (see FIG. 4 in particular). This feature helps to hold the device in place. The invention also has a flexible aperture through which the watch body is pushed. This aperture allows the user to view the watch. Unfortunately, it also exposes the watch face to damage.

Because the aperture must conform to the watch body, different configurations are needed for different watches (as illustrated in FIGS. 2 and 3).

Another type of watch protector is disclosed in U.S. Pat. No. 5,272,682 to Falcone (1993). This invention uses a homogenous piece of flexible material stretched over the watch and band. It is simple in construction—relying on the elastic tension to hold it in place. Unfortunately, it does not allow the user to read the watch while it is in place.

The known devices for protecting a wristwatch are therefore limited in that they:

1. Require the removal of the conventional watch band;
2. Do not remain in position over the watch and band;
3. Must be configured for a particular type of watch; and
4. Disfigure the watch through the use of adhesives and the like.

OBJECTS AND ADVANTAGES

Accordingly, several objects and advantages of the present invention are:

1. To provide a guard which does not require the removal of the conventional watch band;
2. To provide a guard which will remain in position over the watch and band;
3. To provide a guard which may be used on many different types of watches;
4. To provide a guard which does not disfigure the watch through the use of adhesives and the like;
5. To provide a guard which can be installed and removed while the wristwatch remains in place on the user's wrist;
6. To provide a guard which has a secure storage pocket for retaining small items; and
7. To provide a guard which allows the user to access the watch face in order to tell time.

DRAWING FIGURES

REFERENCE NUMERALS IN DRAWINGS

| | | | |
|---|---|---|---|
| 10 | wristwatch guard | 12 | guard band |
| 14 | body cutout | 16 | cover flap |
| 18 | first VELCRO patch | 20 | second VELCRO patch |
| 22 | flap attachment | 24 | band cutout |
| 26 | third VELCRO patch | 28 | fourth VELCRO patch |
| 30 | storage pocket | 32 | pocket flap |
| 34 | fifth VELCRO patch | 36 | sixth VELCRO patch |
| 38 | pocket flap attachment | 40 | pocket seam |
| 42 | wristwatch | 44 | watch body |
| 46 | watch band | 48 | band attachment |
| 50 | adjustment break | 52 | upper portion |
| 54 | lower portion | 56 | pocket opening |
| 58 | seventh VELCRO patch | 60 | eighth VELCRO patch |

DESCRIPTION OF THE INVENTION

Figure 1:
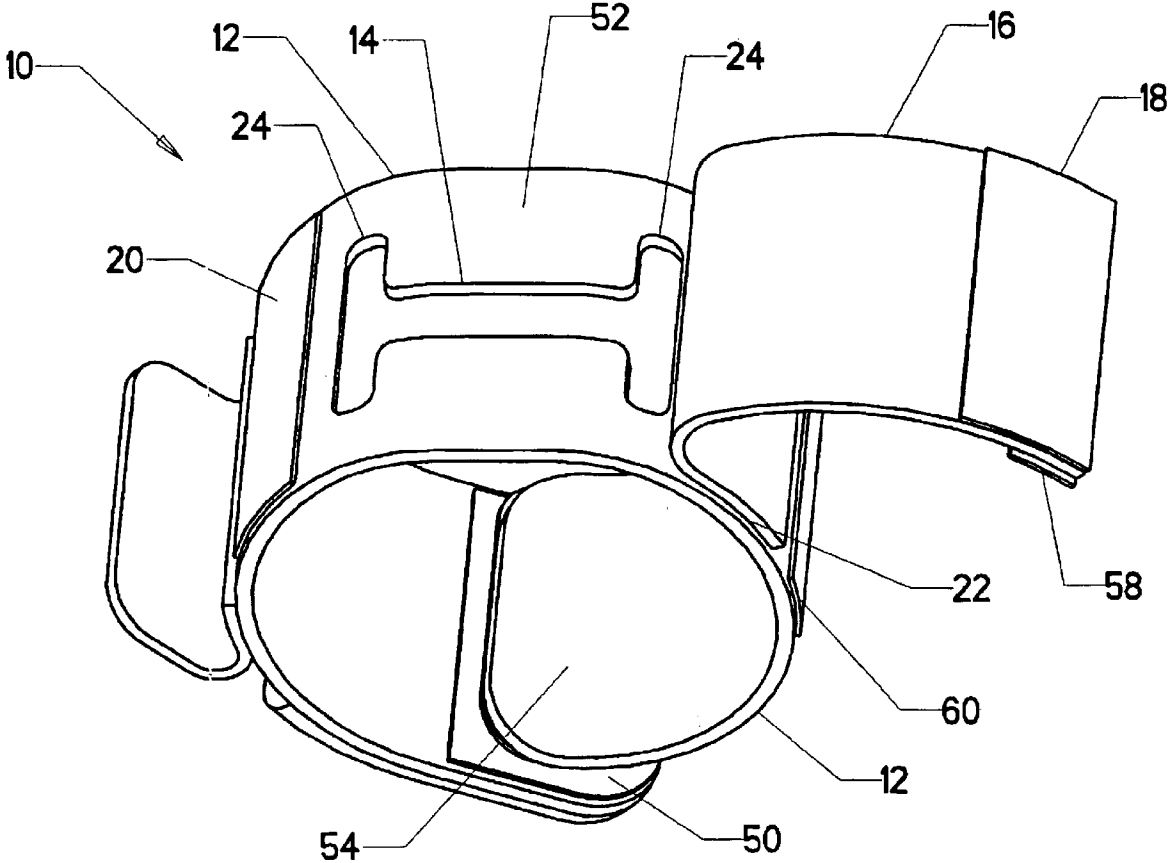
FIG. 1 is an isometric view, showing the proposed invention.

FIG. 1 depicts the proposed invention prior to its application to a wristwatch. Wristwatch guard 10 has two general regions—upper portion 52 and lower portion 54. It consists primarily of the strap denotd as guard band 12, and various other features attached to guard band 12. Lower portion 54 is transected by adjustment break 50. The amount of overlap between the two portions of guard band 12 found at adjustment break 50 allows the diameter of guard band 12 to be adjusted in order to accomodate different wrist sizes.

Figure 2:
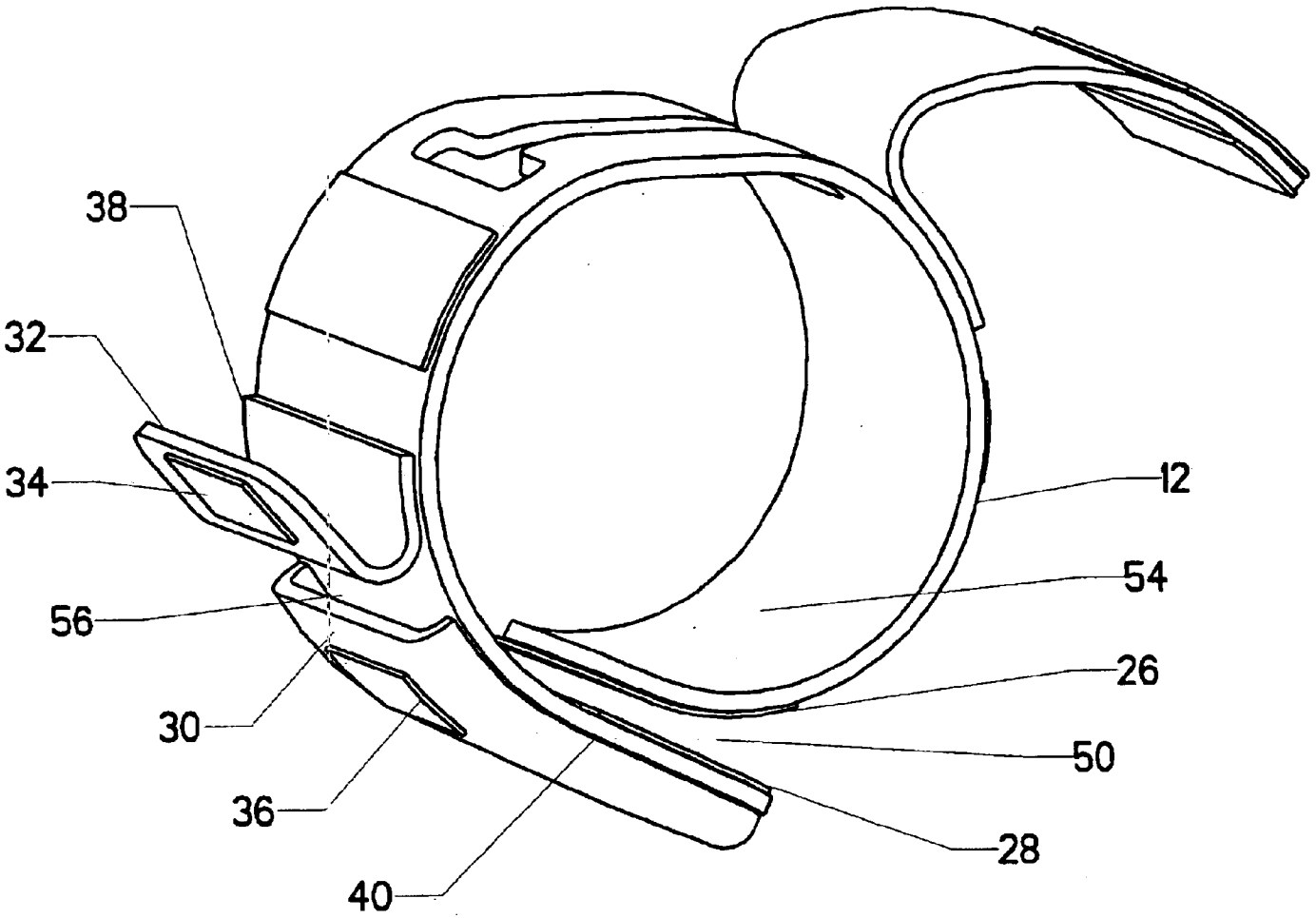
FIG. 2 is an isometric view showing the proposed invention from another perspective.

Once the appropriate diameter for guard band 12 has been established, the two portions at adjustment break 50 must be locked together. This function may be accomplished by a variety of conventional means. Turning briefly to FIG. 2, the user will note that the opposing portions of guard band 12 found at adjustment break 50 are covered by third VELCRO patch 26 and fourth VELCRO patch 28. These two VELCRO patches will adhere to each other when pressed together, thereby maintaining the diameter set for guard band 12.

Returning now to FIG. 1, more elements of the proposed invention will be explained. Upper portion 52 of wristwatch guard 10 has body cutout 14 passing completely through it. Body cutout 14 is oriented in a direction transverse to the axis of the wearer's wrist. At each end of body cutout 14 is a band cutout 24. The result is an opening in the shape of the capital letter "I." Those of this I-shaped opening is to admit a watch body, which will be explained subsequently. Wristwatch guard 10 is made of a very pliable material such as neoprene. This material selection is essential to the function of the invention, as the I-shaped opening must be able to deflect and slip around a watch body. The opening must then close snugly behind the watch body to hold it in place.

Upper portion 52 of wristwatch guard 10 also has cover flap 16. Cover flap 16 is attached to guard band 12 by any conventional means—with stitching or adhesives along flap attachment 22 being two particularly effective methods. FIG. 1 shows cover flap 16 in its open position. It can be retained in this open position by pressing seventh VELCRO flap 58—located on the back side of cover flap 16 in the view shown—against eighth VELCRO patch 60 (located on guard band 12).

Cover flap 16 can be closed across upper portion 52 by moving it in the direction indicated by the arrow. It can then be retained in the closed position by pressing first VELCRO patch 18 against second VELCRO patch 20.

FIG. 2 illustrates more elements of the proposed invention. Lower portion 54 has storage pocket 30 formed on one side. Storage pocket 30, being roughly rectangular in shape, is joined to guard band 12 on three sides—along pocket seam 40. The fourth side comprises pocket opening 56. Pocket opening 56 is sized to allow small items—such as coins or jewelry—to be placed within storage pocket 30.

Pocket flap 32 is provided immediately adjacent to pocket opening 56. Pocket flap 32 is illustrated in the open position. Once items are placed within storage pocket 30, it is desirable to be able to secure them therein. Pocket flap 32 is therefore configured to close over pocket opening 56. Pocket flap 32 is retained in its closed position by pressing fifth VELCRO patch 34 aganst sixth VELCRO patch 36.

Storage pocket 30 is particularly useful when wristwatch guard 10 is used in water sports. If the user is water skiing or riding a jet ski, he or she often has no place to secure coins, jewelry, and the like. Storage pocket 30 solves this problem.

Figure 3:
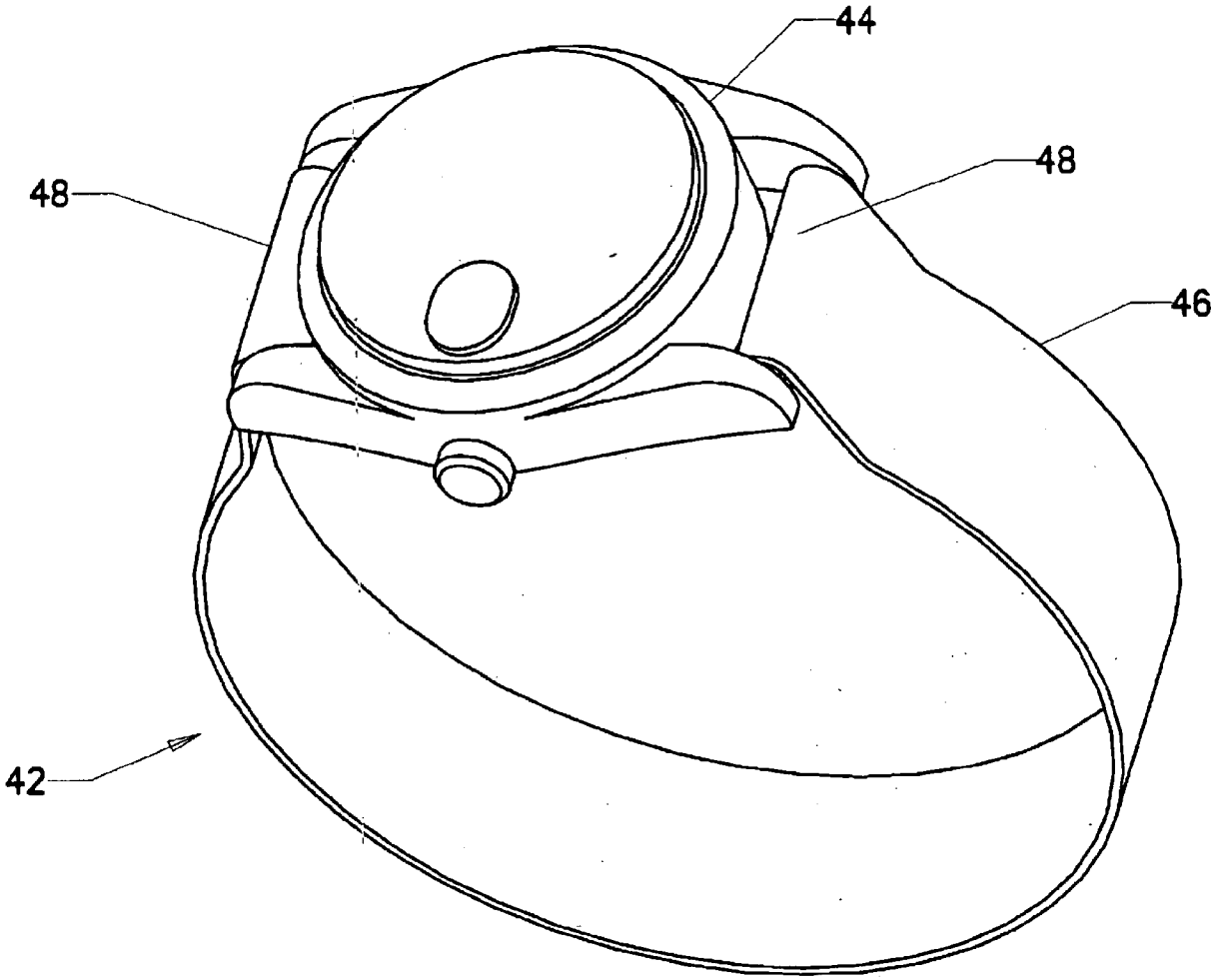
FIG. 3 is an isometric view showing a conventional wristwatch.

Turning now to FIG. 3, the application of the proposed invention to a wristwatch will be explained. FIG. 3 shows wristwatch 42. Most wristwatches have common features. These include watch body 44, watch band 46, and band attachments 48. Those skilled in the art will realize that watch band 46 generally has some type of adjustment feature—such as a buckle or clasp. This type of feature is not significant to the present invention and, accordingly, it has not been illustrated.

Figure 4:
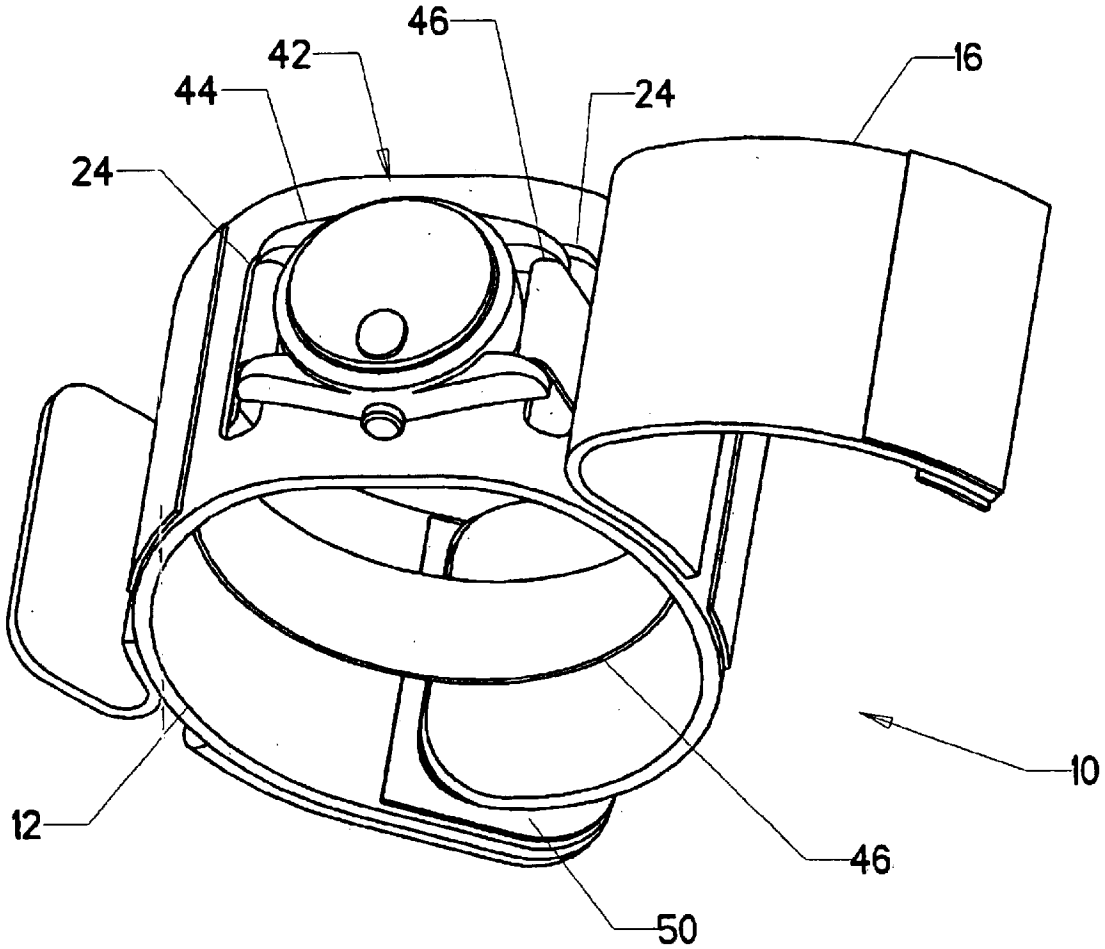
FIG. 4 is an isometric view, showing the proposed invention in conjunction with a conventional wristwatch.

FIG. 4 shows wristwatch guard 10 attached to wristwatch 42. Wristwatch guard 10 is installed by pressing watch body 44 through body cutout 14 (reference FIG. 1). Watch band 46 then fits through the two band cutouts 24. Body cutout 14 then closes beneath watch body 44. Those skilled in the art will readily appreciate that the interaction of watch body 44 and body cutout 14, along with the interaction between watch band 46 and the two band cutouts 24, holds wristwatch 42 firmly in place. Once installed in the position shown, the user then adjusts the diameter of guard band 12 and closes adjustment break 50 as described previously. Watch band 46 is thereby completely covered by wristwatch guard 10.

The reader should note that this installation procedure may be performed while wristwatch 42 is in place on the user's wrist. Likewise, the device may be removed while wristwatch 42 remains in place. In order to remove wristwatch guard 10, the user opens adjustment break 50 and simply tugs upward on the device. Body cutout 14 and band cutouts 24 will then slip over watch body 44 and watch band 46, respectively.

The reader will observe that the face of wristwatch 42 is exposed in the configuration shown in FIG. 4. Cover flap 16 may be secured in this folded-back position, as explained previously. This position allows the observer to see the face of wristwatch 42 and easily tell the time. Of course, the user may often wish to protect the face of wristwatch 42.

Figure 5:
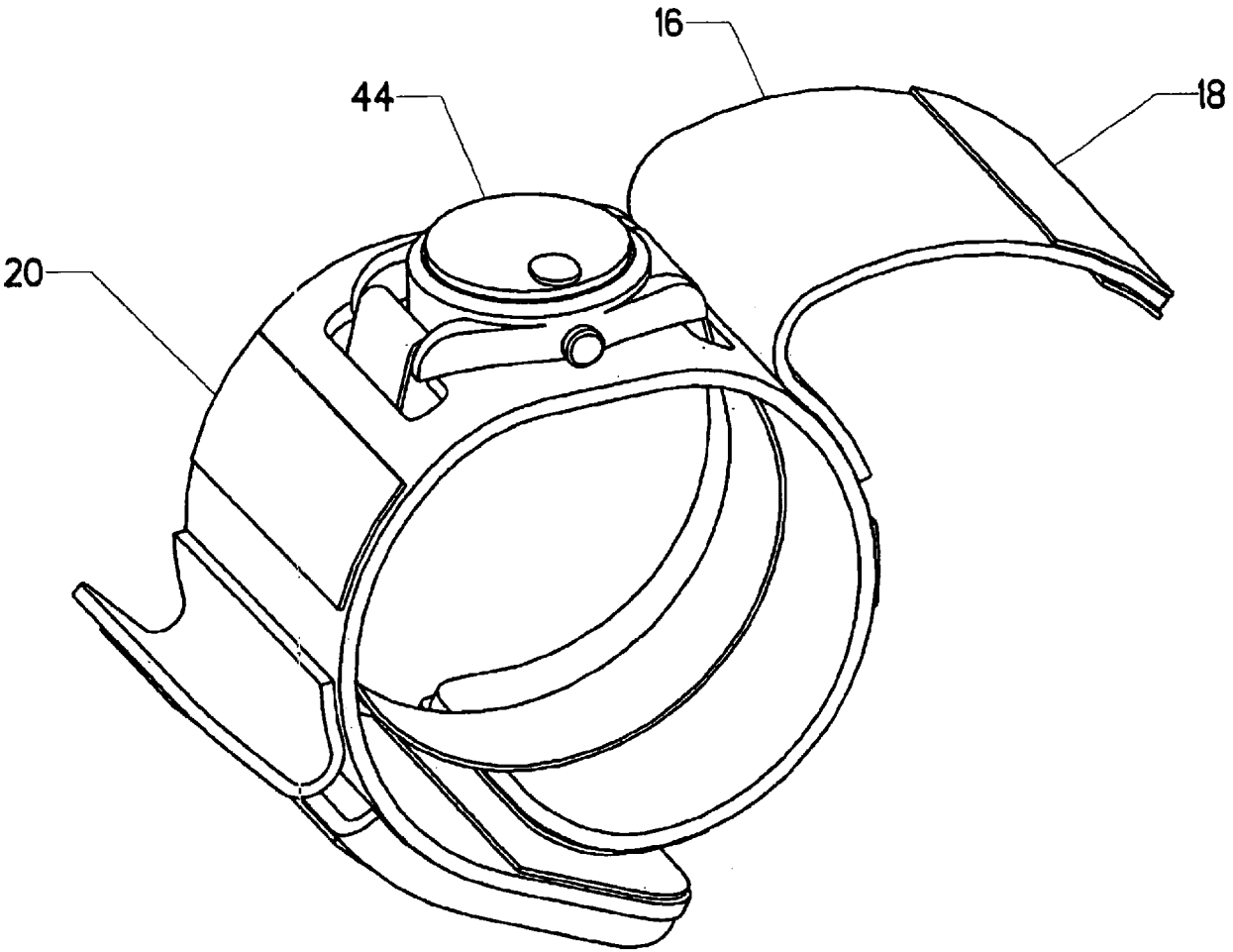
FIG. 5 is an isometric view, showing a different perspective of the proposed invention in conjunction with a conventional wristwatch.

The closure of cover flap 16 is best illustrated in FIG. 5. Cover flap 16 may be closed in the direction indicated by the arrow. This places cover flap 16 over watch body 44. Cover flap 16 is secured in the closed position by pressing first VELCRO patch 18 against second VELCRO patch 20. In this configuration, all components of wristwatch 42 are protected.

Summary, Ramifications, and Scope

Accordingly, the reader will appreciate that the proposed invention protects a wristwatch from damage. The invention has further advantages in that it:

1. Does not require the removal of the conventional watch band;
2. Will remain in position over the watch and band;
3. May be used on many different types of watches;
4. Does not disfigure the watch through the use of adhesives and the like;
5. Can be installed and removed while the wristwatch remains in place on the user's wrist;
6. Has a secure storage pocket for retaining small items; and
7. Allows the user to access the watch face in order to tell time.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A wristwatch guard for protecting a wristwatch, comprised of a watch body and a watch band, worn on a user's wrist, comprising:

a. a circular band of elastomeric material, forming an inner surface and an outer surface with said inner surface being proximate said user's wrist and said outer surface being distal to said user's wrist, having an upper portion and a lower portion, wherein said lower portion is transected by an adjustment break which allows the diameter of said circular band to be adjusted to accommodate variation in the diameter of said wrist of said user;

b. wherein said upper portion opens into a body cutout passing completely therethrough, having a first end and a second end, with said body cutout being oriented transverse to the central axis of said wrist of said user, and being large enough to allow the passage of said watch body therethrough so that said watch body rests on said outer surface when said wristwatch guard is installed on said wristwatch;

c. wherein said upper portion opens into a first band cutout passing completely therethrough, being positioned near said first end of said body cutout, and being oriented parallel to said central axis of said wrist of said user, and being large enough to allow the passage of said watch band therethrough;

d. wherein said upper portion opens into a second band cutout passing completely therethrough, being positioned near said second end of said body cutout, and being oriented parallel to said central axis of said wrist of said user, and being large enough to allow the passage of said watch band therethrough, so that said watchband encircles said user's wrist inside of said inner surface of said circular band, yet remains attached to said watch body resting on said outer surface of said circular band and;

e. wherein said body cutout, said first band cutout, and said second band cutout lie entirely within said circular band.

2. The device as recited in claim 1, wherein said upper portion further comprises a cover flap, attached to said circular band, and positioned to close over said upper portion so that said watch body is sandwiched between said outer surface and said cover flap, thereby protecting said wristwatch.

3. The device as recited in claim 1, wherein said lower portion further comprises a storage pocket having a pocket opening for the insertion and storage of small items, and wherein said pocket opening is located on said outer surface of said circular band.

4. The device as recited in claim 3, wherein said pocket opening is covered by a pocket flap, with said pocket flap having an open position in which said items may be installed or removed from said pocket, and a closed position in which said items are securely retained within said pocket.

* * * * *